United States Patent [19]

Yamamoto et al.

[11] Patent Number: 4,781,113

[45] Date of Patent: Nov. 1, 1988

[54] ELECTRIC CONDUCTION PRINTER

[75] Inventors: Takemi Yamamoto, Nagoya; Masanari Kobayashi; Yasuo Kimura, both of Ichinomiya, all of Japan

[73] Assignee: Brother Kogyo Kabushiki Kaisha, Japan

[21] Appl. No.: 28,090

[22] Filed: Mar. 19, 1987

[30] Foreign Application Priority Data

Mar. 19, 1986 [JP] Japan ..... 61-62502

[51] Int. Cl.[4] ..... B41J 3/12; B41J 3/20

[52] U.S. Cl. ..... 101/93.04; 400/119; 400/120; 346/76 PH; 219/216

[58] Field of Search ..... 400/119, 120; 101/93.04; 346/1.1, 76 PH, 135.1, 160; 219/216, 543

[56] References Cited

U.S. PATENT DOCUMENTS

| | | | |
|---|---|---|---|
| 3,719,261 | 3/1973 | Heinzer | 400/120 |
| 3,771,634 | 11/1973 | Lamb | 400/119 |
| 4,023,184 | 5/1977 | Stillman | 400/120 X |
| 4,163,075 | 7/1979 | Nakano | 346/1.1 X |
| 4,425,569 | 1/1984 | Kawanishi | 400/120 X |
| 4,461,586 | 7/1984 | Kawanishi | 400/120 |
| 4,636,812 | 1/1987 | Bakewell | 400/120 X |
| 4,672,391 | 6/1987 | Hakoyama | 400/120 X |
| 4,678,701 | 7/1987 | Pennington | 400/119 X |

*Primary Examiner*—Paul T. Sewell

*Attorney, Agent, or Firm*—Jones, Tullar & Cooper

[57] ABSTRACT

A plurality of pattern electrodes which are disposed in correspondence with the printing dots are provided on one surface of a substrate biased in one direction. An anisotropic electroconductive element is supported to enable its release on the substrate which has a first turn-on surface contacting the pattern electrodes on its substrate, and a second turn-on surface contacting the electroconductive transfer sheet and exhibiting excellent conductivity between only its first and second turn-on surfaces. In the printing action, electric conduction is achieved on a transfer sheet depending on the printing pattern from the pattern electrodes through the anisotropic element, so that the resistance layer of the sheet may emit heat, thereby the ink contained within the ink layer of the sheet is melted for printing.

8 Claims, 3 Drawing Sheets

ELECTRIC CONDUCTION PRINTER

BACKGROUND OF THE INVENTION

The present invention relates to an electric conduction printer which electrically transmits printing patterns to electrically conductive printing mediums such as printing forms and printing ribbons from a printing head by feeding current to a printing head having a plurality of pattern electrodes corresponding to printing pixels composed of dots.

An electrically conductive printing head which performs so-called electroconductive printing, in which printing is directly conducted onto the printing form by electroconductive action or by transfer from a printing ribbon has a disadvantage in that it can be susceptible to wear and damage because as the electrode feeding current travels its tip is being pressed onto the electrically resistant electroconductive printing form or ribbon. Thus, in order to prevent this, the electrode has conventionally been formed of hard, low resistant special metals which exhibit excellent heat-resistance and resistance to abrasion and wear. However, an electroconductive printing head having electrodes made of such metals has had the following problems which should be thoroughly eliminated.

(1) Hard metals having excellent abrasive resistance and heat-resistance have generaly been difficult to process, and it has been difficult to attain a high density of pixels on the head and to cope with the multiplication of the electrodes.

(2) Moreover, when the electrodes at the used tips are changed, it is wasteful if the drive feeding current to them is also changed, while if only the electrodes are changed independently of the drive it was necessary to finely align the drive portion and the electrodes during setting, and this work was extremely difficult. Such problems cannot be overlooked, particularly in case the head provided with a multiplicity of the electrodes on the head of a shuttle or line printer.

SUMMARY OF THE INVENTION

An object of the invention is to provide a durable electroconductive printer which allows the pixels to be very densely facilitated and the electrodes to be multiplied while eliminating the necessity of complicated and troublesome alignment during maintenance and inspection.

In order to achieve the above-described object, the invention provides an electroconductive printer comprising an electrode carrier member provided on one surface with a pattern of plural electrodes forming a printing pattern which is disposed in correspondence thereto, a printing medium forming the printing images in correspondence with the printing pattern by an electroconductive action, an anisotropic electroconductive element having a first turn-on surface contacting the above-mentioned one surface and forming a turn-on state with the above pattern electrode, and a second turn-on surface contacting the printing medium and forming a turn-on state therewith and having a turn-on performance with respect to at least a single direction passing through the first and second turn-on surfaces.

According to the invention thus constructed, in printing, the anisotropic electroconductive element is turned on through the first electroconductive surface from the pattern electrode, the printing medium is turned on through the second surface, and the printing images are formed on the printing medium in correspondence with the printing pattern formed on the pattern electrodes.

In the above-described arrangement, since the pattern electrode does not directly contact the printing medium, the possibility of the wear and damage of the electrodes which can be caused by the direct contact thereof as in the prior art is completely eliminated, with the result that no stringent requirements are required of the member carrying the pattern electrodes with respect to abrasion resistance and heat-resistance. Consequently, printing pixels can easily be made denser and the electrodes can be multiplied.

Furthermore, no high precision is required of the alignment between the element and the pattern electrodes, and even if the element undergoes wear, the size of a single dot does not vary. Still further, if the element is constructed so as to be replaceable, when the element is subject to wear, since there is no need to change the entire head including the substrate, waste of resources can be avoided. Further, maintenance and inspection are also greatly facilitated together with the alignment work.

DESCRIPTION OF THE PREFERRED EMBODIMENT

Now, a preferred embodiment of the printer according to the invention is described with reference to the appended drawings.

Figure 1:
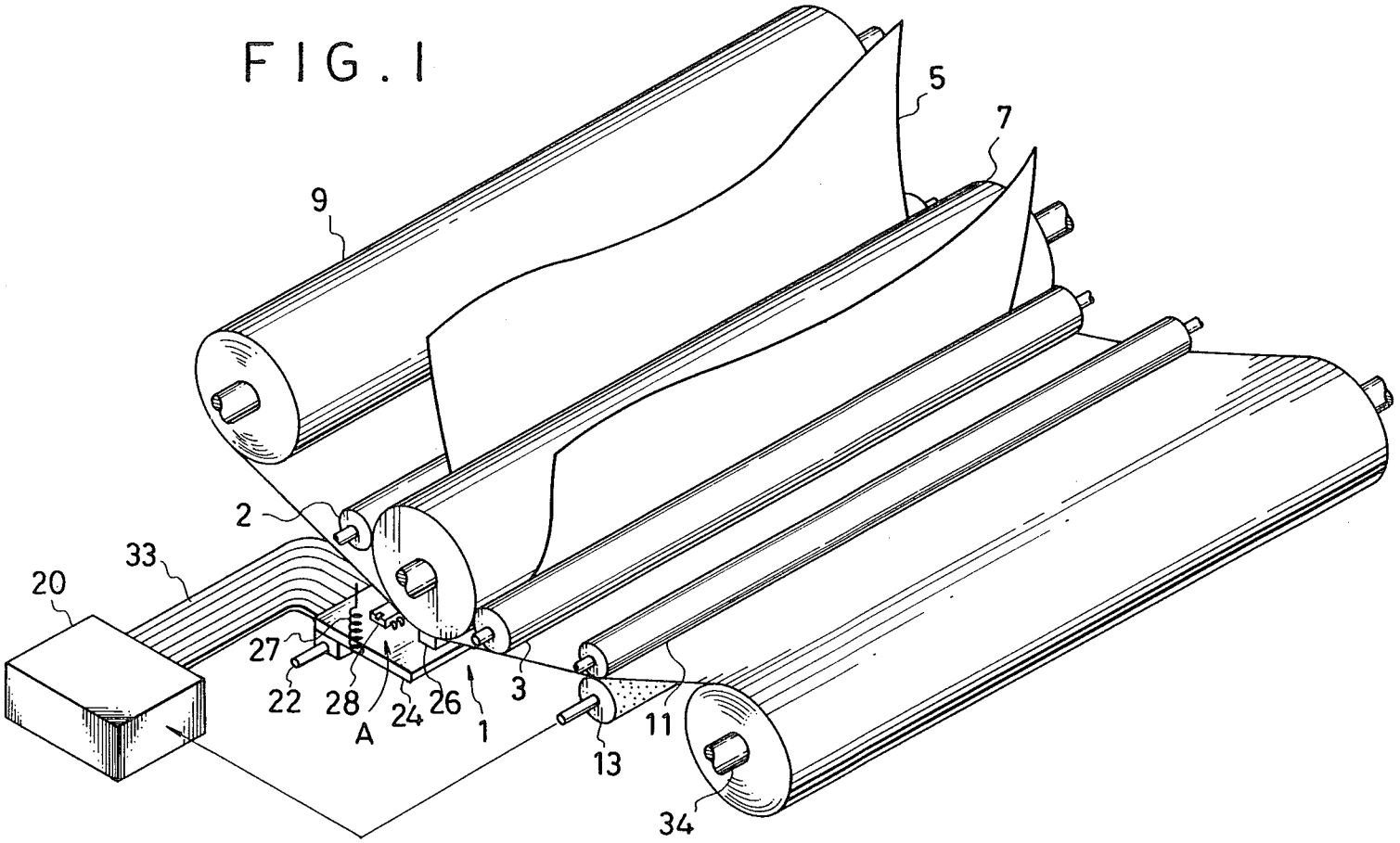
FIG. 1 is a schematic perspective view of a printer provided with an electroconductive device according to the invention.

As shown in FIG. 1, the electroconductive printer according to the present embodiment is composed of a line-type electroconductive transfer head 1, a platen 7 for feeding forms 5 to the electroconductive transfer head 1 together with two feed rollers 2 and 3, an electroconductive transfer sheet 9 as the printing medium which is attached between the form 5 and the head 1, a return electrode roller 13 for snapping and transferring the sheet 9 together with a feed rubber roller 11, and an electronic control device 20 or the like for driving and controlling the transfer head 1. The transfer head 1 is disposed over the entire length of the platen along a printing line under the platen 7.

The head 1 is composed of a substrate 24 whose proximal end is rotatably attached to a rotray shaft 22, and an anisotropic element 26 (described later) forming a main printing portion and which is fixed on the substrate 24 over the direction of width of the form. Moreover, the substrate 24 is biased by a spring 27 in the direction of the arrow A of FIG. 1 so that the element 26 is made to contact the transfer sheet 9 under pressure by a predetermined bias force.

A plurality of driving ICs 28 are packaged on one surface of the substrate for conducting the electroconductive transfer. A multiplicity of pattern electrodes 29 are formed for feeding the current serving to conduct the electroconductive transfer to the element from each output of the driving IC 28. This arrangement is described in more detail with reference to FIG. 2.

Figure 2:
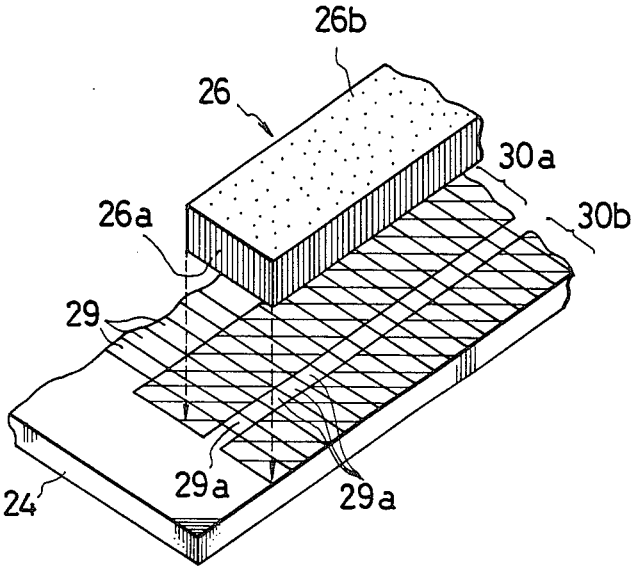
FIG. 2 is a partial perspective view illustrating an exploded printing head portion of FIG. 1.

As shown in FIG. 2, these pattern electrodes 29 are provided in a band-shaped manner along the printing line at intervals equal to the printing density from the driving IC 28 up to that portion on the substrate 24 where the element 26 is fixed. Furthermore, pairs of insulation masks 30*a* and 30*b* spaced apart from each other are applied on those pattern electrodes 29, covering the region illustrated by the oblique line in FIG. 2. These masks 30*a* and 30*b* extend perpendicularly to the pattern electrode 29, element 26. As a result of the pattern electrodes 29, only the rectangular region 29*a* corresponding to the printing dot is exposed along the direction of the printing line. Thus the printing dots with a rectangular form, which form the printing pixels, are densely formed over the entire printing line.

The element 26 is fixed to enable its release by a fixture (not shown), so that an end surface 26*a* extending along the direction of its thickness may contact the exposed region 29*a* of those electrode patterns 29. Although in this embodiment the element 26 is replaceable it may be completely fixed to the substrate 24. Incidentally, the arrangement in which the element 26 is attached to enable replacement has an advantage in that replacement work can easily be conducted when the element 26 undergoes wear or the like.

Figure 3:
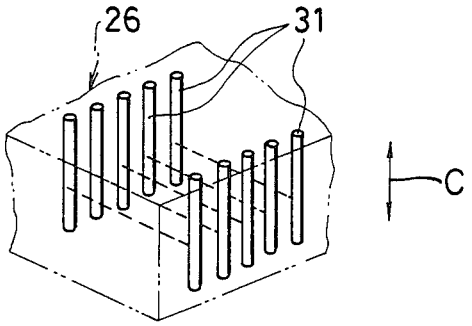
FIG. 3 is an explanatory structural view of an anisotropic electroconductive element made of resin.

The element 26, as shown in FIG. 3, is made of anisotropic electroconductive rubber materials which are embedded in great numbers with fine metallic fibers 31 aligned in their directions, and the direction of thickness, i.e. the direction of the arrow C, and exhibits excellent condcutivity while exhibiting a high insulation in the traverse direction.

Consequently, the surface 26*b* of the element 26 at the side contacting the transfer sheet 9 allows electrical conduction to the transfer sheet 9 over only the region in which the surface 26*a* at the reverse side is taken in the direction of the thickness. Namely, the printing pattern of the electrodes 29 which is electrically represented in the pattern region 29*a* corresponding to the printing dots through the turn-on surface 26*a* of the element 26 is transmitted as it is through the interior of the element to the other turn-on surface 26*b* through which the pattern is transmitted to the contacting transfer sheet 9.

The electronic control device 20 supplies the control signal and the driving power through a flexible print circuit 33 to the driving IC 28 on the substrate 24, which controls the electrical conduction to each pattern electrode 29. As a result, electrical conduction is achieved through the transfer sheet 9 through the element 26, and thereby the printing operation by the electroconductive transfer is achieved.

Figure 4:
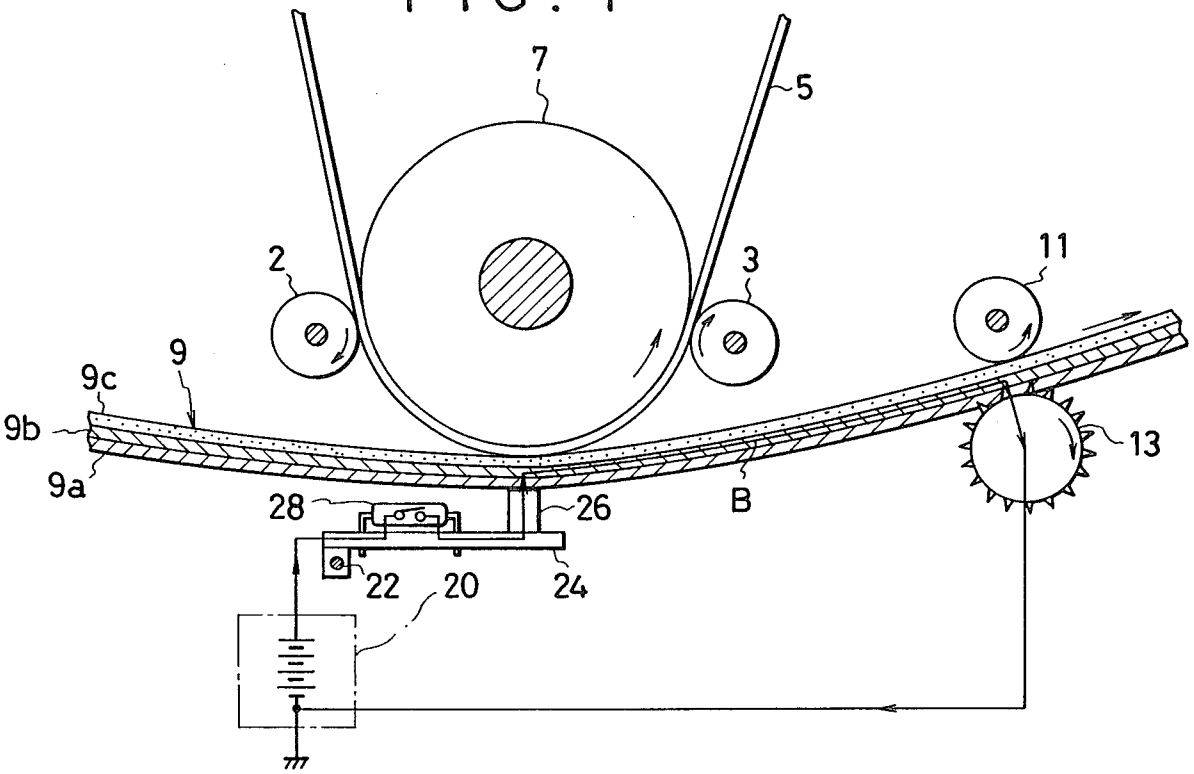
FIG. 4 is an explanatory view illustrating an electroconductive state in the printing operation of the printer in FIG. 1.

Transfer sheet 9 is the printing medium, as shown in FIG. 4, and is composed of an electrical resistance layer 9*a*, return layer 9*b*, and an ink layer 9*c*, and when the electrical conduction from the head 1 is achieved, the current I, as indicated by the arrows B, flows through the driving IC 28, pattern electrodes 29, element 26, resistance layer 9*a*, return layer 9*b*, and return electrodes roller 13. At this time, the resistance layer 9*a*, having a resistance value R, instantaneously emits heat in accordance with the printing pattern and melts the corresponding region of the ink layer 9*c* to transfer the ink to the form 5.

Incidentally, the electrode roller 13 is made of an excellent conductor, for example, metallic roller. Since it is pressed to the rubber roller 11, sharp projections provided along the periphery thereof contact the return layer 9*b* through the electric layer 9*a*. As a result, the return electrode roller 13 serves as the return electrode which passes current I not through the resistance layer 9*a*.

In this way, when single line printing is completed over the direction of the width of the form 5, the form 5 and the transfer sheet 9 are transferred by a single dot. The transfer sheet 9, the ink layer 9*c* of which is melted, is sequentially reeled away about a reel shaft 34 shown in FIG. 1 by a reel mechanism.

In this embodiment constructed as above, since electrical conduction through the transfer sheet 9 is achieved through the element 29, wear or the like of the pattern electrodes 29 need not cause concern, but any materials and fabricating methods appropriate for that purpose may be selected so that high density and multiple electrodes may be achieved. Furthermore, since the element 26 has proper elasticity, an end surface 26*a* of the element 26 taken in the direction of thickness is pressed to the transfer sheet 9 only by the biasing force on the substrate of the spring 27 thereby making excellent contact, so that the electroconductive transfer can be securely achieved.

Likewise, since even if the element 26 wears due to its contact with the sheet, the pressure applied by the element to the sheet is held constant by the spring 27, with the size of the printing dots always held constant. Furthermore, there is no need to make a highly precise alignment between the element and the pattern electrodes 29, and when the element 26 wears, this can be replaced extremely easily. And yet at this time, since the substrate 24 on which the driving IC 28 is placed does not have to be replaced, wasting of resources can be avoided with the running cost also reduced.

Although the preferred embodiment according to the invention is described above, the invention is not restricted thereto, but various modifications can be made thereto without departing from the spirit of the invention. Thus, in place of the transfer sheet, for example, the form for electroconductive printing may be used, and the printing element made of anisotropic electroconductive rubber in which metallic particles are dispersed in a specified direction of conduction, or made of anisotropic electroconductive resin may be used, and further a shuttle type of electroconductive print-head may be used.

What is claimed is:

1. An electric conduction printer, comprising:

an electrode carrier member having a surface on which are provided a plurality of pattern electrodes for forming printing patterns;

a sheet-shaped printing medium which moves relatively to said electrode member and forms pictures printed in accordance with the printing patterns by electric conduction;

an anisotropic electroconductive block member which is mounted on said electrode carrier member and includes a first surface contacting said surface of the carrier member without a substantial relative movement between the first surface and the surface of the carrier member to form an electroconductive state with said pattern electrodes, and a second surface contacting said printing medium to allow a relative movement between the second surface and the printing medium to form an electroconductive state with the printing medium; and said anisotropic electroconductive block member having an electroconductivity in the direction of thickness of said block member passing through said first and second surfaces, whereby the printing patterns are transferred through said block member from said electrode carrier member to the printing medium.

2. The electric conduction printer as defined in claim 1, wherein said anisotropic electroconductive block member is made of an anisotropic electroconductive rubber material.

3. The electric conduction printer as claimed in claim 1, wherein said block member is detachably mounted on said electrodes carrier member.

4. The electric conduction printer as claimed in claim 1, wherein said each pattern electrodes are arrayed side by side in a band-shaped manner, and pairs of insulation masks are covered at predetermined intervals on said arrayed electrodes so that the paired insulation masks extend perpendicularly to the pattern electrodes, thereby forming rectangular dot patterns forming printing pixels.

5. The electric conduction printer as defined in claim 1, further comprising: a spring for biasing said carrier member in one direction so that said anisotropic electroconductive block member may resiliently contact the printing medium.

6. The electric conduction printer as defined in claim 1, wherein said printing medium comprises an electroconductive transfer sheet having an electric resistance layer emitting heat by electrical conduction formed on one surface thereof, and an ink layer melted by heat in accordance with heat emission from said resistance layer being formed on the other surface thereof.

7. The electric conduction printer as defined in claim 6, wherein said transfer sheet has a return layer provided between said resistance layer and said ink layer.

8. An electric conduction printer, comprising:

an electrode carrier member having one surface on which are provided pattern electrodes forming printing patterns;

a printing medium forming pictures printed in accordance with the printing patterns by an electric conduction;

an anisotropic electroconductive element which is detachably mounted on said carrier member and is made of a rubber material having a plurality of fine electroconductive members embedded therein independently of an arrangement of said pattern electrodes, said element being formed in a block with a predetermined thickness and having an electroconductivity in a direction of the thickness thereof; and said element having first and second electroconductive surfaces defining the thickness thereof, said first surface contacting said surface of the carrier member in a fixed state to form an electroconductive state therewith, and said second surface contacting said printing medium to form an electroconductive state therewith, whereby the printing patterns are transferred through only said electroconductive members contacting said pattern electrodes from said surface of the electrode carrier member to the printing medium.

* * * * *